US008137879B2

(12) United States Patent
Veregin et al.

(10) Patent No.: US 8,137,879 B2
(45) Date of Patent: Mar. 20, 2012

(54) FERROMAGNETIC NANOPARTICLES WITH HIGH MAGNETOCRYSTALLINE ANISOTROPY FOR MICR TONER APPLICATIONS

(75) Inventors: Richard P. N. Veregin, Mississauga (CA); Karen A. Moffat, Brantford (CA); Marcel P. Breton, Mississauga (CA); Peter M. Kazmaier, Mississauga (CA); Patricia A. Burns, Oakville (CA); Paul F. Smith, Oakville (CA)

(73) Assignee: Xerox Corporation, Norwalk, CT (US)

( * ) Notice: Subject to any disclaimer, the term of this patent is extended or adjusted under 35 U.S.C. 154(b) by 891 days.

(21) Appl. No.: 12/147,065

(22) Filed: Jun. 26, 2008

(65) Prior Publication Data

US 2009/0325098 A1 Dec. 31, 2009

(51) Int. Cl.
*G03G 9/083* (2006.01)

(52) U.S. Cl. ..... 430/106.2; 430/106.1; 430/111.41; 430/109.4

(58) Field of Classification Search ..... 430/106.1, 430/106.2, 109.4, 111.41
See application file for complete search history.

(56) References Cited

U.S. PATENT DOCUMENTS

| | | | | |
|---|---|---|---|---|
| 4,859,550 | A | 8/1989 | Gruber et al. | |
| 5,124,217 | A | 6/1992 | Gruber et al. | |
| 5,147,744 | A | 9/1992 | Sacripante et al. | |
| 5,667,924 | A * | 9/1997 | Ziolo | 430/106.2 |
| 5,695,901 | A * | 12/1997 | Selim | 430/106.2 |
| 5,976,748 | A | 11/1999 | Arai et al. | |
| 6,048,920 | A * | 4/2000 | Ziolo et al. | 430/106.2 |
| 6,103,437 | A * | 8/2000 | Kozawa et al. | 430/111.4 |
| 6,610,451 | B2 | 8/2003 | Jadwin et al. | |
| 6,677,092 | B2 | 1/2004 | Arai | |
| 6,764,797 | B2 | 7/2004 | Sano et al. | |
| 6,936,396 | B2 | 8/2005 | Patel | |
| 6,942,954 | B2 | 9/2005 | Patel et al. | |
| 6,962,685 | B2 * | 11/2005 | Sun | 423/632 |
| 7,128,891 | B1 * | 10/2006 | Sun | 423/511 |
| 7,214,463 | B2 | 5/2007 | Patel et al. | |
| 7,410,625 | B2 * | 8/2008 | Sun | 423/138 |
| 2005/0051753 | A1 * | 3/2005 | Hayashi et al. | 252/62.56 |
| 2006/0246367 | A1 | 11/2006 | Herbert et al. | |
| 2007/0202424 | A1 * | 8/2007 | Ogawa et al. | 430/106.1 |

FOREIGN PATENT DOCUMENTS

| | | | |
|---|---|---|---|
| JP | 53-107338 A | * | 9/1978 |
| JP | 55138752 A | * | 10/1980 |

OTHER PUBLICATIONS

Diamond, Arthur S & David Weiss (eds.) Handbook of Imaging Materials, 2nd ed.. New York: Marcel-Dekker, Inc. (Nov. 2001) pp. 178-182.*

Chemical Abstracts AN 90:113014 (1978).*

English language translation of JP 55-138752 (Oct. 1980).*

Elkins, Kevin et al. "Monodisperse face-centred tetragonal FePt nanoparticles with giant coercivity." *J. Phys. D. Appl. Phys.*, vol. 38, pp. 2306-2309 (2005).

Li, Daren et al. "Hard magnetic FePt nanoparticles by salt-matrix annealing", *J. Appl. Phys.*, vol. 99, 08E911 (2006).

Luborsky, Fred et al. "High Coercive Materials: Development of Elongated Particle Magnets", *J. Appl. Phys.*, Supp to vol. 32 (3), pp. 171S-184S (Mar. 1961).

Watari, Fumio et al. "Effect of Crystalline Properties on Coercive Force in Iron Acicular Fine Particles", *J. Mater. Sci.*, vol. 23, pp. 1260-1264 (1988).

Tzitzios, Vassilios et al., "Synthesis and Characterization of $L1_0$ FePt Nanoparticles from Pt (Au, Ag)/ $\gamma$-$Fe_2O_3$ Core-Shell Nanoparticles", *Adv. Mater.*, vol. 17, pp. 2188-2192 (2005).

Shah, Lubna Rafiq et al., "Effective Magnetic Anisotropy and Coercivity in Fe Nanoparticles Prepared by Inert Gas Condensation", *Int. J. Modern Phys. B*, vol. 20 (1), pp. 37-47 (2006).

Bonder, M.J. et al., "Controlling Synthesis of Fe Nanoparticles with Polyethylene Glycol", *J. Magn. Magn. Mater.*, vol. 311 (2), pp. 658-664 (2007).

* cited by examiner

*Primary Examiner* — Christopher Rodee
(74) *Attorney, Agent, or Firm* — Oliff & Berridge, PLC

(57) ABSTRACT

A toner including stabilized magnetic single-crystal nanoparticles, wherein the value of the magnetic anisotropy of the magnetic nanoparticles is greater than or equal to $2\times10^4$ J/m$^3$. The magnetic nanoparticle may be a ferromagnetic nanoparticle, such as FePt. The toner includes a magnetic material that minimizes the size of the particle, resulting in excellent magnetic pigment dispersion and dispersion stability, particularly in emulsion/aggregation toner processes. The smaller sized magnetic particles of the toner also maintains excellent magnetic properties, thereby reducing the amount of magnetic particle loading required in the toner.

16 Claims, No Drawings

FERROMAGNETIC NANOPARTICLES WITH HIGH MAGNETOCRYSTALLINE ANISOTROPY FOR MICR TONER APPLICATIONS

TECHNICAL FIELD OF THE DISCLOSURE

The present disclosure relates to a MICR toner comprising stabilized magnetic single-crystal nanoparticles, wherein the absolute value of the magnetic anisotropy of the magnetic nanoparticles |K1| is greater than or equal to $2\times10^4$ J/m$^3$. The magnetic nanoparticle may be a ferromagnetic nanoparticle, such as FePt. The toner includes a magnetic material that minimizes the size of the particle, resulting in excellent magnetic pigment dispersion and dispersion stability, particularly during emulsion/aggregation processes. The smaller-sized magnetic toner particles also maintain excellent magnetic properties, thereby reducing the amount of magnetic particle loading required in the toner. This helps to avoid common problems associated with a high loading of inert non-melting magnetic materials, such as interference with other toner properties, such as, for example, fusing.

BACKGROUND

Magnetic Ink Character Recognition (MICR) technology is well-known. MICR toners contain a magnetic pigment or a magnetic component in an amount sufficient to generate a magnetic signal strong enough to be readable via MICR. Generally, the toner is used to print all or a portion of a document, such as checks, bonds, security cards, etc. For example, most checks exhibit an identification code area, usually at the bottom of the check. The characters of this identification code are usually MICR encoded. The document may be printed with a combination of MICR-readable toner and non-MICR-readable toner, or with just MICR-readable toner. The document thus printed is then exposed to an appropriate source or field of magnetization, at which time the magnetic particles become aligned as they accept and retain a magnetic signal. The document can then be authenticated by passing it through a reader device, which detects or "reads" the magnetic signal of the MICR imprinted characters, in order to authenticate or validate the document.

MICR toners contain a magnetic material that provides the required magnetic properties. It is important that the magnetic material retains a sufficient charge so that the printed characters retain their readable characteristic and are easily detected by the detection device or reader. The magnetic charge retained by a magnetic material is known as "remanence." The "coercive force" of a magnetic material refers to the magnetic field H, which must be applied to a magnetic material in a symmetrical, cyclicly magnetized fashion, to make the magnetic induction B vanish. The coercivity of a magnetic material is thus the coercive force of the material in a hysterisis loop, whose maximum induction approximates the saturation induction. The observed remanent magnetization and the observed coercivity of a magnetic material depend on the magnetic material having some anisotropy to provide a preferred orientation for the magnetic moment in the crystal. Four major anisotropy forces determine the particle coercive force: magnetocrystalline anisotropy, strain anisotropy, exchange anisotropy, and shape anisotropy. The two dominant anisotropies are: 1) shape anisotropy, wherein the preferred magnetic orientation is along the axis of the magnetic crystal, and 2) magnetocrystalline anisotropy, wherein the electron spin-orbit coupling aligns the magnetic moment with a preferred crystalline axis.

The magnetic material should exhibit sufficient remanence once exposed to a source of magnetization, in order to generate a MICR-readable signal and have the capability to retain the signal over time. Generally, an acceptable level of charge, as set by industry standards, is between 50 and 200 Signal Level Units, with 100 being the nominal value, which is defined from a standard developed by ANSI (the American National Standards Instituter. A lesser signal may not be detected by the MICR reading device, and a greater signal may also not give an accurate reading. Because the documents being read employ the MICR printed characters as a means of authenticating or validating the presented documents, it is important that the MICR characters or other indicia be accurately read, without skipping or misreading any characters. Therefore, for purposes of MICR toner, remanence of the magnetic material should be at least a minimum of 20 emu/g to enable sufficient magnetization of the toner for MICR without use of excessively high pigment loadings in the toner. High pigment loadings in the toner poses difficulties in the toner preparation process and may negatively impact toner performance, and therefore high pigment loadings are undesirable. A higher remanence value in the toner corresponds to a stronger readable signal from the toner image.

Remanence tends to increase as a function of particle size and the density of the magnetic pigment coating. Accordingly, when the magnetic particle size decreases, the magnetic particles tend to experience a corresponding reduction in remanence. Achieving sufficient signal strength thus becomes increasingly difficult as the magnetic particle size diminishes and the practical limits on percent content of magnetic particles in the toner composition are reached. A higher remanence value will require less total percent magnetic particles in the toner formula, improve suspension properties, and reduce the likelihood of settling as compared to a toner formula with higher percent magnetic particle content.

Magnetite (iron oxide, $Fe_2O_3$) is a common magnetic material used in MICR toners. Magnetite has a low magnetocrystalline anisotropy, K1, of $-1.1\times10^4$ J/m$^3$. An acicular crystal shaped magnetite, in which one crystal dimension is much larger than the other, has an aspect ratio of the major to minor size axis of the single crystal ($D_{major}/D_{minor}$) of 2:1 or larger, helps to augment the magnetic remanence and coercivity performance in toners. Acicular magnetite is typically 0.6×0.1 micron in size along the major and minor axis, respectively, and has a large shape anisotropy (6/1). Typical loading of iron oxide in toners is about 20 to 40 weight percent of the total toner weight. However, due to the larger sizes and aspect ratio of acicular crystal shaped magnetite particles, they are difficult to disperse and stabilize into toners, especially in emulsion/aggregation processes. Moreover, spherical or cubic magnetites are smaller in size (less than 200 nm in all dimensions), but have low shape anisotropy ($D_{major}/D_{minor}$) of about 1. Consequently, because of the low overall anisotropy, both low shape anisotropy and low magnetocrystalline anisotropy, spherical or cubic magnetite have lower magnetic remanence and coercivity, and loadings higher than 40 weight percent of the total toner weight are often needed to provide magnetic performance. Thus, while spherical and cubic magnetite have the desired smaller particle size of less than 200 nm in all dimensions, the much higher loading requirement also makes them very difficult to disperse and maintain a stable dispersion. Moreover, such high loadings of the inert, non-melting magnetic material interfere with other toner properties, such as adhesion to the substrate and scratch resistance. Consequently, this worsens the suitability of magnetites for MICR toners.

REFERENCES

U.S. Pat. No. 4,859,550 describes an electrophotographic process comprising generating a latent image; developing the image with a toner composition comprised of resin particles, magnetite particles and an additive component comprised of an aliphatic hydrocarbon or a polymeric alcohol; and subsequently providing the developed image with magnetic ink characters thereon to a reader/sorter device, whereby toner offsetting and image smearing is minimized in the device.

U.S. Pat. No. 5,124,217 describes a MICR process, wherein an electrophotographic process enables substantially tamperproof images, including the generation of a latent image. It also describes developing the image with a toner composition comprised of resin particles, magnetite particles, and a colored organic soluble dye, a colored organic insoluble dye, or the salts thereof, and an optional additive component comprised of an aliphatic hydrocarbon or a polymeric alcohol.

U.S. Pat. No. 5,976,748 describes a magnetic toner for a MICR printer containing a binder resin and a magnetic powder, prepared in such a way that the magnetic powder includes a first magnetic powder having a residual magnetization value within a range of 24 to 40 emu/g and a second magnetic powder having a residual magnetization value within a range of 1 to 24 emu/g (but exclusive of 1 emu/g), and the residual magnetization value of the magnetic toner for a MICR printer is within a range of 7.0 to 20 emu/g (but exclusive of 7.0 emu/g).

U.S. Pat. No. 6,610,451 describes development systems and methods for developing, using magnetic toners, developers used in development systems, as well as the toner used in developers for MICR printing.

U.S. Pat. No. 6,764,797 describes a toner composition for MICR applications, including at least a binder resin, magnetite particles comprising a mixture of granular magnetite and acicular magnetite, and a wax. The ratio by weight of the acicular magnetite in the magnetite particles is 0.1-0.5 to the granular magnetite of 1.0. The magnetite particles are contained in an amount of 15-50 weight percent of the total toner weight. The granular magnetite has residual magnetization of 5-15 emu/g and saturation magnetization of 70-95 emu/g. The acicular magnetite has residual magnetization of 20-50 emu/g and saturation magnetization of 70-95 emu/g.

U.S. Pat. No. 5,147,744 describes a colored magnetic encapsulated toner composition including a core comprised of a polymer binder, magnetic metal particles, whitener, color pigment, dye or mixtures thereof. The core is encapsulated in a polymeric shell, and the toner surface includes an optional conductive metal oxide, or metal oxides and an optional release additive, or additives.

U.S. Pat. No. 6,942,954 describes a toner process involving heating a mixture of an acicular magnetite dispersion, a colorant dispersion, a wax dispersion, a first latex containing a cross-linked resin, and a second latex containing a resin free of cross-linking in the presence of a coagulant. This produces aggregates, which are stabilized with a silicate salt dissolved in a base. Further heating of the aggregates provide coalesced toner particles.

U.S. Pat. No. 6,936,396 describes a toner process including heating a mixture of an acicular magnetite dispersion, a colorant dispersion, a wax dispersion, a first latex containing a cross-linked resin, a second latex containing a resin substantially free of cross-linking, a coagulant and a silica. This toner possesses a shape factor of from about 120 to about 150.

U.S. Pat. No. 6,677,092 describes a magnetic toner for MICR printers. The base particle of the toner includes a binder resin and magnetic powder. On the outer surface of each base particle, metal oxide particles are provided. The metal oxide particles have a volume resistivity of $1\times10^5$ to $1\times10^{11}$ Ω·cm. A developer containing this MICR toner makes it possible to provide superior image density and reading precision, even after 150,000 to 300,000 sheets of A-4 paper have been continuously printed.

U.S. Pat. No. 7,214,463 describes a toner process including a first heating, in the presence of a coagulant, of a mixture of an acicular magnetite dispersion, a colorant dispersion, a wax dispersion, and a core latex comprised of a first latex containing a vinyl crystalline polyester resin substantially free of cross-linking. The polyester is substantially dissolved in a vinyl monomer and polymerized to provide the first core latex resin. The mixture contains a second cross-linked resin containing latex. The presence of a coagulant provides aggregates. The process further includes adding a shell latex including a polymer substantially free of cross-linking, and further heating the aggregates to provide coalesced toner particles. The latter heating step is performed at a higher temperature than the first heating step.

U.S. Patent Application Publication No. 2006/0246367 describes a magnetic toner composition including a carbon nanofoam and a polymer, a magnetic ink composition including a carbon nanofoam and a fluid carrier; and a xerographic process that includes depositing a toner composition on a latent electrostatic image to form a toner image. It also describes MICR processes including providing a substrate having a magnetic composition including a carbon nanofoam applied thereto to form at least one recognizable character, and scanning the substrate with a reading device.

Elkins et al., *Monodisperse face-centred tetragonal FePt nanoparticles with giant coercivity*, J. Phys. D. Appl. Pbys. (38) pp. 2306-09 (2005), and Li et al, *Hard magnetic FePt nanoparticles by salt-matrix annealing*, J. Appl. Phy. 99, 08E911 (2006), describe preparation of monodisperse fct-phase FePt nanoparticles with high magnetic anisotropy and high coercivity by a new heat treatment route.

Luborsky et al., *High Coercive Materials: Development of Elongated Particle Magnets*, J. App. Phys., Supp to Vol. 32 (3), pp. 171S-184S (1961), reviews the development of permanent magnet materials.

Watari et al., *Effect of Crystalline Properties on Coercive Force in Iron Acicular Fine Particles*, J. of Mater. Sci., 23, pp. 1260-64 (1988), describes the orientation relation of iron acicular fine particles and its size dependence, and the relationship between crystallographic properties and magnetic properties.

Tzitzios et al., *Synthesis and Characterization of* $L1_0$ *FePt Nanoparticles from Pt (Au, Ag)/γ-*$Fe_2O_3$ *Core-Shell Nanoparticles*, Adv, Mater. 17, pp. 2188-92 (2005), describes a method of synthesis and the characterization of $L1_0$ FePt nanoparticles from Pt (Au, Ag)/γ-$Fe_2O_3$ core-shell nanoparticles.

The appropriate components and process aspects of each of the foregoing may be selected for the present disclosure in embodiments thereof, and the entire disclosures of the above-mentioned references are entirely incorporated herein by reference.

SUMMARY

The present disclosure relates to a toner that is suitable for MICR toner printing and embodies some or all of the above-listed advantages. The toner includes single crystal magnetic nanoparticles, wherein the size of the nanoparticles is from about 10 nm to about 300 nm, and the absolute value of the magnetocrystalline anisotropy, |K1|, is greater than or equal to $2\times10^4$ J/m$^3$. The magnetic nanoparticles in embodiments may be bimetallic or trimetallic, and have low aspect ratio and exhibit better dispersion and stability. In one embodiment, the nanoparticles are single crystal ferromagnetic nanoparticles. Such single crystal ferromagnetic nanoparticles, including the smaller size non-acicular particles, have very high magnetic shape anisotropy. Accordingly, these single crystal ferromagnetic nanoparticles demonstrate the requisite high remanance and coercivity suitable for MICR toner applications.

Various magnetic nanoparticles may be used in the toners according to the present disclosure. For example, FePt nanoparticles are suitable for MICR toner applications because they exhibit high magnetic anisotropy and, therefore, high coercivity. FePt exists in two phases: a face-centered cubic (fcc) phase and a face-centered tetragonal (fet) phase. The fct phase FePt has very high magnetocrystalline anisotropy. The fct phase FePt nanoparticle can be synthesized from the fcc phase FePt nanoparticle, according to, for example, the methods taught by Elkins et al., *Monodisperse Face-Centred Tetragonal FePt Nanoparticles with Giant Coercivity*, J. Phys. D: Appl. Phys. pp. 2306-09 (2005); Li et al, *Hard Magnetic FePt Nanoparticles by Salt-Matrix Annealing*, J. Appl. Phy. 99, 08E911 (2006); or Tzitios et al., *Synthesis and Characterization of $L1_0$ FePt Nanoparticles From Pt (Au, Ag)/γ-$Fe_2O_3$ Core-Shell Nanoparticles*, Adv. Mater. 17, pp. 2188-92 (2005). Other suitable magnetic nanoparticles include metallic Fe nanoparticles, which have the required high magnetocrystalline anisotropy of about $4\times10^4$ J/m$^3$, as measured by Luborsky, J. Appl. Phys, Supplement to Vol 32 (3), 171S-184S (1961). Metallic Fe nanoparticles with the required properties for MICR applications can be prepared according to, for example, the methods taught by Watari et al., *Effect of Crystalline Properties on Coercive Force in Iron Acicular Fine Particles*, J. Materials Sci., 23, 1260-1264 (1988); Shah et al., *Effective Magnetic Anisotropy and Coercivity in Fe Nanoparticles Prepared by Inert Gas Condensation*, Int. J. of Modern Phys. B. Vol 20 (1), 37-47 (2006); or Bonder et al., *Controlling Synthesis of Fe Nanoparticles with Polyethylene Glycol*, J. Magn. Magn. Mater. 311(2), 658-664 (2007). The MICR toner of the present disclosure includes a magnetic material that advantageously uses smaller sized magnetic particles, resulting in excellent magnetic pigment dispersion and dispersion stability, particularly in emulsion/aggregation process toners. Moreover, the smaller sized magnetic particles of the MICR toner also maintains excellent magnetic properties, thereby reducing the amount of magnetic particle loading required in the toner.

EMBODIMENTS

In general, the present disclosure relates to a toner including a magnetic nanoparticle exhibiting large anisotropy. The toner may additionally include one or more resins, one or more colorants, one or more waxes, and/or one or more additives. In one embodiment, the magnetic nanoparticles are metallic nanoparticles. In another embodiment, the magnetic nanoparticles are single crystal ferromagnetic nanoparticles. The toner is suitable for use in various applications, including MICR applications. In addition, the printed marking produced by the toner may be used for decoration purposes, even if the resulting markings do not sufficiently exhibit coercivity and remanence suitable for use in MICR applications. The toner of the present disclosure exhibits stability, dispersion properties and magnetic properties that are superior to that of a toner including magnetite. The toner composition is now described in detail.

This disclosure is not limited to particular embodiments described herein, and some components and processes may be varied by one of ordinary skill in the art, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise.

In this specification and the claims that follow, "toner" is also referred to as "toner composition," and vice versa.

The Magnetic Material

Suitable magnetic material for use in the present disclosure include single crystal nanoparticles exhibiting large anisotropy. Used herein, "large anisotropy" is defined as the absolute value of the magnetocrystalline anisotropy of a particle, wherein the absolute value is equal to or greater than $2\times10^4$ J/m$^3$. In one embodiment, the magnetic materials have a K1 value from about $5\times10^4$ J/m$^3$ to about $5\times10^6$ J/m$^3$. In another embodiment, the K1 values are from about $2\times10^4$ J/m$^3$ to about $5\times10^7$ J/m$^3$. However, magnetic materials having even higher K1 values may also be used.

In embodiments, the single crystal nanoparticle may be a magnetic metallic nanoparticle, or a ferromagnetic nanoparticle with a large anisotropy that includes, for example, Co and Fe (cubic), among others. Additionally, the magnetic nanoparticles may be bimetallic or trimetallic, or a mixture thereof. Examples of suitable bimetallic magnetic nanoparticles include, without limitation, CoPt, fcc phase FePt, fct phase FePt, FeCo, MnAl, MnBi, $CoO.Fe_2O_3$, $BaO.6Fe_2O_3$, a mixture thereof, and the like. In another embodiment, the magnetic nanoparticle is fct phase FePt. Examples of trimetallic nanoparticles can include, without limitation, tri-mixtures of the above or core/shell structures that form trimetallic nanoparticles, such as Co-covered fct phase FePt.

The magnetic nanoparticles may be prepared by any method known in the art, including ball-milling attrition of larger particles (a common method used in nano-sized pigment production), followed by annealing. The annealing is generally necessary because ball milling often produces amorphous nanoparticles, which desirably are subsequently crystallized into the single crystal form. The nanoparticles can also be made directly by RF plasma. Appropriate large-scale RF plasma reactors are available from, for example, Tekna Plasma Systems. The nanoparticles can also be made by a number of in situ methods in solvents, including water.

The magnetic nanoparticles may be of any shape, including cubical and hexagonal. Additional exemplary shapes of the magnetic nanoparticles can include, for example, without limitation, needle-shape, granular, globular, amorphous shapes, and the like.

Each dimension of the magnetic nanoparticles may be about 10 nm to about 500 m in size, such as about 10 nm to about 300 nm, or about 50 nM to about 300 nm, although the amount can be outside of these ranges. Herein, "average" particle size is typically represented as $d_{50}$, or defined as the median particle size value at the $50^{th}$ percentile of the particle size distribution, wherein 50% of the particles in the distribution are greater than the $d_{50}$ particle size value, and the other 50% of the particles in the distribution are less than the $d_{50}$ value. Average particle size can be measured by methods that use light scattering technology to infer particle size, such as Dynamic Light Scattering. The particle diameter refers to the length of the pigment particle as derived from images of the particles generated by Transmission Electron Microscopy (TEM).

The ratio of the major to minor size axis of the single nanocrystal ($D_{major}/D_{minor}$) can be less than about 4:1, such as about 3:2 or about 2:1. Of course, particles of different aspect ratios can also be used, as desired.

The loading requirements of the magnetic nanoparticles in the toner may be from about 0.5 weight percent to about 15 weight percent of the weight of the toner, such as about 2 weight percent to about 10 weight percent, or about 5 weight percent to about 8 weight percent, although the amount can be outside of these ranges.

The magnetic nanoparticle may have a remanence of about 20 emu/g to about 100 emu/g, such as about 30 emu/g to about 80 emu/g, or about 40 emu/g to about 55 emu/g, although the amount can be outside of these ranges.

The coercivity of the magnetic nanoparticles may be about 200 Oersteds to about 50,000 Oersteds, such as about 1000 Oersteds to about 40,000 Oersteds, or about 10,000 Oersteds to about 25,000 Oersteds, although the amount can be outside of these ranges.

The magnetic saturation moment may be, for example, about 20 emu/g to about 150 emu/g. In one embodiment, the magnetic saturation moment can be about 30 emu/g to about 70 emu/g.

Examples of suitable magnetic nanoparticle compositions with large magnetocrystalline anisotropy, K1, are shown in Table 1. Table 1 also shows a reference magnetite. Note that actual coercivity obtained for nanocrystalline materials may be lower than the maximum coercivity shown here, because coercivity is strongly size-dependent. Peak coercivity for Fe and Co occurs when the particles are about 20 nm in size, and peak coercivity for $CoO.Fe_2O_3$ occurs when the particles are about 30 nm in size. Another suitable magnetic material with high magentocrystalline anisotropy include, for example, CoPt, with K1 value of $4.9\times10^6$ J/m$^3$.

TABLE 1

| | Magnetocrystalline Anisotropy ($10^4$ J/m$^3$) | Maximum Coercivity (Oersteds) |
|---|---|---|
| MICR Toner Requirement | ≧2 | ≧300 |
| Reference Magnetite[ref 2] ($Fe_3O_4$ or $FeO\bullet Fe_2O_3$) | 1.1 | 460 |
| FePt (face-centered tetragonal)[ref 3] | 660 | ≧9000 |
| Fe (cubic)[ref 2] | 4 | 1000 |
| Co[ref 2] | 40 | 2100 |
| $CoO\bullet Fe_2O_3$[ref 2] | 25 | 4200 |
| $BaO\bullet 6Fe_2O_3$[ref 2] | 33 | 4500 |
| MnAl[ref 2] | 100 | 6000 |
| MnBi[ref 2] | 116 | 12000 |

[ref 2] F. E. Luborsky, J. Appl. Phys., Supp. to Vol. 32 (3), 171S-184S (1961) and the references therein.
[ref 3] V. Tzitzios et al., Adv. Mater. 17, 2188-92 (2005).

Examples of magnetic nanocrystals with high magnetocrystalline anisotropy that have been prepared in the literature are shown in Table 2. Any of the particles shown below are suitable for MICR toner applications.

TABLE 2

| Particle Chemistry (Crystal Structure) | Size (nm) | Saturation Moment (emu/g) | Remanent Moment (emu/g) | Coercivity (Oersteds) | Magnetocrystalline Anistotropy ($10^4$ J/m$^3$) |
|---|---|---|---|---|---|
| MICR Toner Requirement for magnetic particles | 10 to 330 | No specific requirement | >20 | ≧300 | ≧2 |
| FePt (fct)[ref 4] | 8 cubic | >40 | 30 | 30,000 | 660 |
| FePt (fct)[ref 4] | 15 cubic | >50 | 40 | 20,000 | 660 |
| Fe (bcc)[ref 1] | 20 × 20 × 200 | 145 | 72.2 | 1540 | 4.8[ref 2] |

fct = face-centered tetragonal crystal structure;
bcc = body-centered cubic crystal structure
[ref 1] F. Watari, et al., J. Mater. Sci., 23, pp. 1260-64 (1988).
[ref 4] K. Elkins, et al., J. Phys. D. Appl. Phys., 38, pp. 2306-09 (2005).

Nevertheless, it is known that a large inherent magnetocrystalline anisotropy of a material does not ensure that the material will have a high remanence or high coercivity that will render the material suitable for MICR applications. Similarly, FePt alloys, Fe or Co do not necessarily have the required remanence or coercivity. A particular material is generally suitable for MICR application only if the material has both: 1) a large inherent magnetocrystalline anisotropy, and 2) single crystal domains where the domain size is at least about 10 nm (the exact minimum size limit depends on the material).

Additionally, it is possible to produce a toner containing a bimetallic magnetic nanoparticle whose absolute value of the magnetocrystalline anisotropy K1 is greater than $2\times10^4$ J/m$^3$, and is at least one of FeCo or $Fe_2O_3$. This may be achieved by any means known in the art. For example, a toner containing FePt crystalline nanoparticles may be mixed with a toner containing $Fe_2O_3$. Alternatively, FePt crystalline nanoparticles and $Fe_2O_3$ may be added into the toner during toner synthesis. Such mixtures thus combine the relatively inexpensive $Fe_2O_3$ with the improved magnetic and dispersion properties of FePt crystalline nanoparticles, to produce a MICR toner. In such mixtures, the ratio of magnetic nanoparticles to FeCo or $Fe_2O_3$ is about 0.1 to about 99.9, or reverse. For such mixtures, the loading requirement is from about 0.5 weight percent to about 15 weight percent of the weight of the toner, such as about 2 weight percent to about 8 weight percent, or about 3 weight percent to about 5 weight percent, although the amount can be outside of these ranges.

Binder Resin

The toner according to the present disclosure may also include one or more binder resins. Additionally, a cross-linking structure may be partly introduced to a binder resin in order to improve the stability during storage, the shape-retaining property, or the durability of a toner if an amount of the cross-linking part (amount of gel) can be about 10 weight % lower, although the amount can be outside of this range.

The binder resin may be any suitable agent, including, without limitation, a maleic modified rosin ester (trademark Beckacite 4503 resin from Arizona chemical company), branched or crosslinked polyester resins, phenolics, maleics, modified phenolics, rosin ester, and modified rosin, phenotic modified ester resins, rosin modified hydrocarbon resins, hydrocarbon resins, terpene phenolic resins, terpene modified hydrocarbon resins, polyamide resins, tall oil rosins, polyterpene resins, hydrocarbon modified terpene resins, acrylic and acrylic modified resins and similar resins or rosins known to be used in toners and the like.

Other suitable binder resins include, without limitation, thermoplastic resins, homopolymers of styrene or substituted styrenes such as polystyrene, polychloroethyene, and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyvinyl butyral; polyacrylic resin; rosin; terpene resin; phenolic resin; aliphatic hydrocarbon resin; aromatic petroleum resin; chlorinated paraffin; paraffin wax, and the like. These binder resins can be used alone or in combination. The molecular weight, molecular weight distribution, cross-linking degree and other properties of each of the above binder resins are selected in conventional amounts for their usual purposes.

Amorphous Polyester Binder Resins

In embodiments, the binder resins may be linear or branched amorphous polyester polymers such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(propoxylated bisphenol-fumarate), poly(propoxylated bisphenol-succinate), poly(propoxylated bisphenol-adipate), poly(propoxylated bisphenol-glutarate), SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOIL™ (Ashland Chemical), CELANEX™ (Celanese Eng), RYNITE™ (DuPont), STYPOL™ (Freeman Chemical Corporation), mixtures thereof, and the like.

The amorphous polyester resins may be functionalized by any suitable means in the art. Any suitable functional moieties may be attached to the resin. In embodiments, the binder resin may be carboxylated, or sulfonated, such as sodio sulfonated, and the like. The amorphous resins may have glass transition temperatures (Tg) of from about 40° C. to about 80° C., such as from about 50° C. to about 70° C. (as measured by differential scanning calorimetry (DSC)), although the value can be outside of these ranges. The linear and branched amorphous polyester resins may have a number average molecular weight (Mn) of from about 10,000 to about 500,000, such as from about 5,000 to about 250,000 (as measured by gel permeation chromatography (GPC)), although the value can be outside of these ranges; a weight average molecular weight (Mw) of from about 20,000 to about 600,000, such as from about 7,000 to about 300,000 (as determined by GPC using polystyrene standards); and a molecular weight distribution (Mw/Mn) of from about 1.5 to about 6, such as from about 2 to about 4, although the value can be outside of these ranges.

The amorphous polyester resins may be prepared by suitable means known in the art, and then be incorporated into a toner composition. For example, a polypropoxylated bisphenol A fumarate polyester, Bisphenol A, propylene oxide or propylene carbonate and fumaric acid may be used as monomeric components in the process of the present disclosure while a propoxylated bisphenol A fumarate may be utilized as a seed resin to facilitate formation of the latex. A linear propoxylated bisphenol A fumarate resin which may be utilized as a seed resin is available under the trade name SPARII from Resana S/A Industrias Quimicas, Sao Paulo, Brazil. Other commercially available propoxylated bisphenol A fumarate resins include GTUF and FPESL-2 from Kao Corporation, Japan, and EM181635 from Reichhold, Research Triangle Park, N.C., and the like.

Examples of suitable diacids or diesters selected for the preparation of amorphous polyester resins include, with limitations, dicarboxylic acids or diesters, such as terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfimarate, dimethylmaleate, dimethylglutarate, dimethyladipate, dimethyl dodecylsuccinate, mixtures thereof, and the like. The organic diacid or diester may be used in amounts such as from about 40 to about 55, such as from 45 to about 52, mole percent of the resin, although values outside of these ranges may be used.

Examples of suitable diols utilized in producing amorphous polyester resins include, without limitation, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. The amount of organic diol selected can vary, and may be from about 40 to about 55, such as from about 45 to about 52, mole percent of the resin, although values outside of these ranges may be used.

Additionally, production of amorphous sulfonated polyester resin further requires inclusion of one or more branching agents such as a multivalent polyacid or polyol. Branching agents suitable for use in forming the branched amorphous polyester include, without limitation, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent may be used in an amount of from about 0.1 to about 8 mole percent of the resin, such as from about 0.1 to about 5 mole percent, although the value may be outside of these ranges.

Crystalline Polyester Resin

In addition, the core portion of the toner particles may include one or more crystalline polyester resins. However, the shell is substantially free of crystalline polyester. Examples of crystalline polyester resins include poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(ododecylene-adipate), poly(ethylene-glutarate), poly(propylene-glutarate), poly(butylene-glutarate), poly(pentylene-glutarate), poly(hexylene-glutarate), poly(octylene-glutarate), poly(nonylene-glutarate), poly(decylene-glutarate), poly(undecylene-glutarate), poly(ododecylene-glutarate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(ododecylene-succinate), poly(ethylene-pimelate), poly(propylene-pimelate), poly(butylene-pimelate), poly(pentylene-pimelate), poly(hexylene-pimelate), poly(octylene-pimelate), poly(nonylene-pimelate), poly(decylene-pimelate), poly(undecylene-pimelate), poly(ododecylene-pimelate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(ododecylene-sebacate), poly(ethylene-azelate), poly(propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(ododecylene-azelate), poly(ethylene-dodecanoate), poly(propylene-dodecanoate), polybutylene-dodecanoate), poly(pentylene-dodecanoate), poly(hexylene-dodecanoate), poly(octylene-dodecanoate), poly(nonylene-dodecanoate), poly(decylene-dodecanoate), poly(undecylene-dodecanoate), poly(ododecylene-dodecanoate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), poly(undecylene-fumarate), poly(ododecylene-fumarate), copoly-(butylene-fumarate)-copoly-(hexylene-fumarate), copoly-(ethylene-dodecanoate)-copoly-(ethylene-fumarate), mixtures thereof, and the like.

The crystalline resin may be present in an amount of from about 3 to about 20 percent by weight of the core, such as from about 5 to about 15 percent by weight or from about 5 to about 10 percent by weight of the core, although the value may be outside of these ranges.

The crystalline resin can have a melting point of at least about 60° C., such as from about 70° C. to about 80° C., although the value may outside of these ranges. The crystalline resin may have a number average molecular weight (Mn), as measured by gel permeation chromatography (GPC), of from about 1,000 to about 50,000, such as from about 2,000 to about 25,000, although the value may be outside of these ranges; a weight average molecular weight (Mw) as determined by GPC using polystyrene standards, of from about 2,000 to about 100,000, such as from about 3,000 to about 80,000, although the value may be outside of these ranges; and a molecular weight distribution (Mw/Mn) of about 2 to about 6, such as from about 3 to about 4, although the value may be outside of these ranges.

Crystalline polyester resins may be prepared by any known means in the art, such as by a polycondensation process involving reacting an organic diol and an organic diacid in the presence of a polycondensation catalyst. Although generally, a stoichiometric equimolar ratio of organic diol and organic diacid is utilized. However, in some instances wherein the boiling point of the organic diol is from about 180° C. to about 230° C., an excess amount of diol can be utilized and removed during the polycondensation process. Additional amounts of acid may be used to obtain a high acid number for the resin, for example an excess of diacid monomer or anhydride may be used. The amount of catalyst utilized varies, and can be selected in an amount, for example, of from about 0.01 to about 1 mole percent of the resin, although the amount may be outside of this range.

Examples of organic diols suitable for the preparation of crystalline polyester resins are the same as those used for the preparation of the amorphous polyester resin. Examples of organic diacids or diesters selected for the preparation of the crystalline resins are the same as those used for the preparation of amorphous polyester resin as disclosed above.

Examples of suitable polycondensation catalysts for the preparation of crystalline or amorphous polyester resins include, without limitation, tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin, although the amount may be outside of this range.

Colorants

The toner according to the present disclosure may be produced as a colored toner, by adding a colorant during toner production. Alternatively, a non-conductive colored toner may be printed on a substrate during a first pass, followed by a second pass, wherein a conductive toner that is lacking a colorant is printed directly over the colored toner, so as to render the colored toner conductive. In such instance, the order in which the two toners are printed are interchangeable. This can be achieved through any means known in the art. For example, each toner can be stored in a separate reservoir. The printing system delivers each toner separately to the substrate, and the two toners interact. The toners may be delivered to the substrate simultaneously or consecutively. Any desired or effective colorant can be employed in the toner compositions, including pigment, dye, mixtures of pigment and dye, mixtures of pigments, mixtures of dyes, and the like. The metallic nanoparticles may also, in embodiments, impart some or all of the colorant properties to the toner composition.

Suitable colorants for use in the toner according to the present disclosure include, without limitation, carbon black, lamp black, iron black, ultramarine, Aniline Black, Aniline Blue, azo oil black, Basic 6G Lake, Benzidine Yellow, Benzimidazolone Brown HFR, Benzimidazolone Carmine HF3C, Brilliant Green lakes, carbon black, Chrome Yellow, Dioxazine Violet, disazo pigments, Disazo Yellow AAA, Du Pont Oil Red, Fast Yellow G, Hansa Brilliant Yellow 5GX, Hansa Yellow, Hansa Yellow G, Lake Red C, Malachite Green hexylate, Malachite Green, metallic salts of salicylic acid and salicylic acid derivatives, Methyl Violet Lake, Methylene Blue Chloride Methylene Blue, monoazo pigments, Naphthol Red HFG, Naphtol Yellow, Nigrosine dye, oil black, Phthalocyanine Blue, Phthalocyanine Green, quinacridone, Quinoline Yellow; Rhodamine 6G Lake, Rhodamine B; Rose Bengale, Tartrazine Lake, tertiary ammonium salts, titanium oxide, trisazo pigments, Ultramarine Blue, Victoria Blue, Watching Red, mixtures thereof, and the like.

The amount of colorant can vary over a wide range, for instance, from about 3 to about 20 weight % of the total toner weight, and combinations of colorants may be used.

Wax

One or more waxes may be added to the toner, in order to raise the image density and to effectively prevent the offset to a reading head and the image smearing. The wax can be present in an amount of, for example, from about 0.1 to about 10 weight % or in an amount of from about 1 to about 6 weight % based on the total weight of the toner composition. Examples of suitable waxes include, but are not limited to, polyolefin waxes, such as low molecular weight polyethylene, polypropylene, a fluorocarbon-based wax (Teflon), or Fischer-Tropsch wax, copolymers thereof, mixtures thereof, and the like.

The toner composition can also optionally contain an antioxidant. The optional antioxidants protect the images from oxidation and also protect the toner components from oxidation during the heating portion of the toner preparation process. Specific examples of suitable antioxidants include NAUGUARD® series of antioxidants, such as NAUGUARD® 445, NAUGUARD® 524, NAUGUARD® 76, and NAUGUARD® 512 (commercially available from Uniroyal Chemical Company), the IRGANOX® series of antioxidants such as IRGANOX® 1010 (commercially available from Ciba Geigy), and the like. When present, the optional antioxidant can be present in the toner in any desired or effective amount, such as in an amount of from at least about 0.01 to about 20 weight % of the total toner weight, such as about 0.1 to about 5 weight %, or from about 1 to about 3 weight %, although the amount may be outside of these ranges.

Other optional additives include clarifiers, such as UNION CAMP® X37-523-235 (commercially available from Union Camp); tackifiers, such as FORAL® 85, a glycerol ester of hydrogenated abietic (rosin) acid (commercially available from Hercules), FORAL® 105, a pentaerythritol ester of hydroabietic (rosin) acid (commercially available from Hercules), CELLOLYN® 21, a hydroabietic (rosin) alcohol ester of phthalic acid (commercially available from Hercules), ARAKAWA KE-311 Resin, a triglyceride of hydrogenated abietic (rosin) acid (commercially available from Arakawa Chemical Industries, Ltd.), synthetic polyterpene resins such as NEVTAC® 2300, NEVTAC® 100, and NEVTAC® 80 (commercially available from Neville Chemical Company), WINGTACK® 86, a modified synthetic polyterpene resin (commercially available from Goodyear), and the like; adhesives, such as VERSAMID® 757, 759, or 744 (commercially available from Henkel), plasticizers, such as UNIPLEX® 250 (commercially available from Uniplex), the phthalate ester plasticizers commercially available from Monsanto under the trade name SANTICIZER®, such as dioctyl phthalate, diundecyl phthalate, alkylbenzyl phthalate (SANTICIZER® 278), triphenyl phosphate (commercially available from Monsanto), KP-140®, a tributoxyethyl phosphate (commercially available from FMC Corporation), MORFLEX® 150, a dicyclohexyl phthalate (commercially available from Morflex Chemical Company Inc.), trioctyl trimellitate (commercially available from Eastman Kodak Co.), and the like. Such additives may be included in conventional amounts for their usual purposes.

Charge-Controlling Agent

For MICR applications, a charge-controlling agent may be added to the toner in order to help improve the electrification level and an electrification rate (index of electrification to specific charge level during short time) and to obtain excellent fluidity.

There are two types of charge-regulating agent generally suitable for adding to the toner: a charge-controlling agent (CCA) having a function to control charge (electrification amount) within a specific range and a charge-controlling resin (CCR) having a function to reinforce charge (electrification amount). One, or both, types of agents may be added to the toner.

As the charge-controlling agent (CCA), azines, direct dyes comprising azines, nigrosin compounds, metallic salts, alkoxylated amines, alkylamides, and quaternary ammonium salts, and combination of two of these compounds can be used. In particular, nigrosin compounds enable rapid start-up of electrification amount and easy control of saturated electrification amount.

As the charge-controlling resin (CCR), a resin or an oligomer having quaternary ammonium salt; a resin or an oligomer having carboxylic acid salt; a resin or an oligomer having carboxylic acid residue or combinations of two of these compounds can be used.

In one embodiment, the toner includes styrene-acryl copolymer having quaternary ammonium salt, carboxylic acid salt, or carboxylic acid residue, which allows further promotion of electrification amount.

The loading of a charge-control agent may be from about 0.1 to about 10 weight percent. If the loadings of the charge-regulating agent is less than 0.1 weight percent, regulation of charge may not be effectively functioned. On the other hand, if the loadings of charge-regulating agent is more than 10 weight percent, the dispersibility and the durability of toner may decrease. Therefore, in order to balance the charge-regulating function, the durability of the toner, and other properties well, the loadings of the charge-regulating agent is about 0.5 weight percent to about 8 weight percent of the toner, such as from about 1.0 to about 5 weight percent of the weight of the toner, although the amount may be outside of these ranges.

Surfactants

Examples of nonionic surfactants that may be used in the toner according to the present disclosure include, without limitation, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol, and the like, and mixtures thereof.

Examples of suitable cationic surfactants include, without limitation, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$-trimethyl ammonium bromides, halide salts of quaternized polyoxyethylalkylamines, dodecylbenzyl triethyl ammonium chloride, and the like, and mixtures thereof.

A suitable amount of surfactant can be selected, such as in an amount of about 0.1 to about 10 weight percent, such as about 0.2 to about 5 weight percent, although the amount may be outside of the ranges. The choice of particular surfactants or combinations thereof as well as the amounts of each to be used are within the purview of those skilled in the art.

Further, olefin-maleic acid, anhydride copolymer, and the like, may be added to obtain toner images having high quality without deterioration of developing property.

The toner according to this disclosure may be produced by an emulsion aggregation procedure. Any suitable emulsion aggregation procedure may be used in forming the emulsion aggregation toner particles without restriction. These procedures typically include the basic process steps of at least aggregating an emulsion containing polymer binder and one or more optional waxes, one or more optional colorants, one or more surfactants, an optional coagulant, and one or more additional optional additives to form aggregates, subsequently coalescing or fusing the aggregates, and then recovering, optionally washing and optionally drying the obtained emulsion aggregation toner particles. However, in embodiments, the process further includes magnetic nanoparticles in the aggregation step.

Suitable emulsion aggregation/coalescing processes for the preparation of toners, and which can be modified to include the magnetic nanoparticles as described herein, are illustrated in a number of Xerox patents, the disclosures of each of which are entirely incorporated herein by reference, such as U.S. Pat. Nos. 5,290,654; 5,278,020; 5,308,734; 5,370,963; 5,344,738; 5,403,693; 5,418,108; 5,364,729; and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby entirely incorporated herein by reference. In addition, U.S. Pat. Nos. 6,627,373; 6,656,657; 6,617,092; 6,638,677; 6,576,389; 6,664,017; 6,656,658; and 6,673,505 are each hereby entirely incorporated herein by reference. The appropriate components and process aspects of each of the foregoing U.S. patents may be selected for the present composition and process in embodiments thereof.

In embodiments hereof, the toner process comprises forming a toner particle by mixing the polymer latex, in the presence of metallic nanoparticles, an optional wax and an optional colorant dispersion to which is added an optional coagulant while blending at high speeds such as with a polytron. The resulting mixture having a pH of, for example, about 2.5 to about 3.5 is aggregated by heating to a temperature below the polymer resin Tg to provide toner size aggregates. Optionally, additional latex can be added to the formed aggregates to provide a shell over the formed aggregates. The pH of the mixture is then changed, for example by adding a sodium hydroxide solution until a pH of about 7.0 is achieved, and optionally also adding a metal sequestering agent such as tetrasodium ethylene diamine tetracetate. The temperature of the mixture is then raised to above the resin Tg, such as to about 95° C. After about 30 minutes, the pH of the mixture is reduced to a value sufficient to coalesce or fuse the aggregates to provide a composite particle upon farther heating such as about 5.5 to about 6.5. The fused particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular basis. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.980.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Printing of the Toner

The magnetic metal particle toner may generally be printed on a suitable substrate such as, without limitation, paper, glass art paper, bond paper, paperboard, Kraft paper, cardboard, semi-synthetic paper or plastic sheets, such as polyester or polyethylene sheets, and the like. These various substrates can be provided in their natural state, such as uncoated paper, or they can be provided in modified forms, such as coated or treated papers or cardboard, printed papers or cardboard, and the like.

For printing the MICR toner on a substrate, any suitable printing method may be used. For example, suitable methods include, without limitation, roll-to-roll high volume analog printing methods, such as gravure, rotogravure, flexography, lithography, etching, screenprinting, and the like. Additionally, thermography, electrophotography, electrography, laser induced transfer, or a combination thereof may be used. If a laser induced transfer digital printing method is used, exemplary methods of such method are dye sublimination, ablation, melt transfer, or film transfer. The toner may also be used for a thermal transfer printer, a hot-melt printer and ordinary instrument for writing.

The toner of the present disclosure may be used in both MICR and non-MICR applications, including, for example, magnetic SCD, magnetic imaging methods printing on a magnetic latent image) and reduction of image background by magnetic forces.

EXAMPLES

Preparation of a Latex Emulsion

Step 1: Preparation of an Aqueous Surfactant Phase

A surfactant solution of 434 g of DOWFAX 2A1™ (anionic emulsifier) and 387 kg of deionized water is mixed for 10 minutes in a stainless steel holding tank. The holding tank is then purged with nitrogen for 5 minutes before transferring the mixture into a reactor. The reactor is then continuously purged with nitrogen while being stirred at 100 RPM. The reactor is then heated to 80° C.

Step 2: Preparation of an Initiator Solution 6.11 kg of ammonium persulfate initiator is dissolved in 30.2 kg of deionized water.

Step 3: Preparation of a Monomer Emulsion 315.7 kg of styrene, 91.66 kg of butyl acrylate, 12.21 kg of beta-CEA, 7.13 kg of 1-dodecanethiol, 1.42 kg of decanediol diacrylate (ADOD), 8.24 kg of DOWFAX 2A1™ (anionic surfactant), and 193 kg of deionized water are mixed to form a monomer emulsion.

To the reactor containing the aqueous surfactant phase prepared in step 1 above, 5% of the monomer emulsion prepared in step 3 above is slowly fed with a nitrogen purge at 80° C. to form a latex emulsion. The initiator solution formed in step 2 above is then slowly charged into the reactor, producing latex particles of about 5 to 12 nm in diameter. After 10 minutes, the remaining 95% of the monomer emulsion is continuously fed in using metering pumps. The reactor temperature is maintained at 80° C. for 2 hours thereafter to allow the reaction to complete. The contents of the reactor are cooled to about 25° C. The resulting isolated latex emulsion is comprised of 40 weight % of styrene/butylacrylate/beta CEA latex particles suspended in an aqueous phase containing the surfactant. The particles have a diameter of approximately 200 nm.

Preparation of Wax Dispersion

An aqueous wax dispersion is prepared by using PW725 polyethylene wax (Mw 725, melting point 104° C., available from Baker-Petrolite) and DOWFAX 2A1™ as an anionic surfactant/dispersant. The wax particles were approximately 200 nm in diameter. The wax dispersion is 30% by weight wax, 68% by weight water and 2% by weight anionic surfactant.

Preparation of Carbon Black Pigment Solution

Carbon black (REGAL 330R™) pigment supplied from Sun Chemicals and an anionic surfactant are dispersed in water to form a solution of 19% pigment, 2% surfactant, and 79% water.

Preparation of Magnetic Pigment Dispersions

Magnetic Pigment Example A

Magnetic Fe particles are prepared according to the procedure described by Watari et al., *J. Materials Science,* 23, 1260-1264 (1988), herein incorporated by reference in its entirety. The mineral goethite α-FeOOH with 0.5 μm particle size is reduced under isothermal heat treatment at 400° C. in a hydrogen atmosphere for 2 hours to convert the particles to Fe metal particles of 20×20×200 nm size, with an aspect ratio of 10/1, remnant moment of 72.2 emu/g, coercivity of 1540 Oersteds, and magnetocrystalline anisotropy of about $4\times10^4$ $J/m^3$, as measured by the method described by Luborsky, *J. Appl. Phys, Supplement to Vol* 32 (3), 171S-184S (1961). 19.7 g of magnetic Fe particles are added to 300 g of water containing 1.3 g of 20% aqueous anionic surfactant Dowfax 2A1™. 83 g of the carbon black pigment solution prepared as described above are added and ball milled for 3 hours to produce the pigment dispersion.

Magnetic Pigment Example B

Magnetic FePt particles are prepared according to the procedure described by Li, et al., *J. Applied Physics* 99, 08E911 (2006), herein incorporated by reference in its entirety. 15 nm fcc FePt nanoparticles are chemically synthesized in an argon atmosphere. NaCl powder that has been ball milled for 24 hours is dispersed in hexane and mixed. The hexane dispersion and the fcc FePt nanoparticles are mixed. The ratio of NaCl:FePt is 100:1. The mixture is stirred until all the solvent evaporates, then annealed in forming gas (93% $H_2$ and 7% Ar) at 700° C. for 2 hrs to convert the fcc FePt to fct FePt, followed by washing and drying steps. The magnetic fct FePt particles have a diameter of about 15 nm, an aspect ratio of 1/1, remnant moment of about 40 emu/g, coercivity of 20,000 Oersteds, and magnetocrystalline anisotropy of $660\times10^4$ J/m$^3$. 39.9 g of the magnetic FePt particles are added to 300 g of water containing 1.3 g of 20% aqueous anionic surfactant Dowfax 2A1™. 83 g of 18% carbon black pigment solution prepared as described above are added and ball milled for 3 hours to produce the pigment dispersion.

Toner Particle Example I

Toner with 8% Fe Magnetic Pigment

Magnetic Pigment Example A is aggregated with 330 g of the latex emulsion prepared as described above; 90 g of the wax dispersion prepared as described above; and 3 g of a coagulant of 10% by weight polyaluminum chloride (PAC) solids dissolved in nitric acid. The mixture is heated to about 54° C. to produce particles of 5.2 μm in diameter. Adding 130 g of the latex emulsion and mixing the mixture for about 30 minutes produces particles of about 5.8 μm in diameter. The pH of the mixture is adjusted to pH of 7.5 with an aqueous solution of 4% NaOH, then heated to 93° C., during which the pH is maintained at 7.5 by adding the aqueous solution of 4% NaOH, Using an aqueous 2.5% nitric acid solution, the pH of the mixture is adjusted to 5 over 1 to 2 hours, then heated again to produce particles with a desired a smooth morphology. The toner is washed 4 times with water and dried on a freeze dryer.

Toner Particle Example II

Toner with 15% of Magnetic FePt Pigment

The toner particles are prepared as described in Toner Particle Example I, but magnetic pigment prepared as described in Example B, instead of the magnetic pigment prepared as described in Example A, is used.

Toner Particle Example III

Polyester Toner with 8% Magnetic Fe Pigment

In a 2 liter beaker, the following are added under homogenization: 1) 368.24 g of linear amorphous polyester resin emulsion (17.03 wt % solids, prepared by melt condensation of ethoxylated or propoxylated bisphenol A and fumaric acid, wherein the repeat unit varies from about 5 to 1000); 2) 45.03 g of unsaturated crystalline polyester resin emulsion (31.98 wt % solids, containing ethylene glycol and a mixture of dodecanedioic acid and fumaric acid co-monomers, wherein the number of dodecanedioic acid—ethylene glycol repeat unit varies from 5 to 2000 and the number of fumaric acid—ethylene glycol varies from 5 to 2000 repeat units); 3) 107.21 g of magnetic Fe/carbon black pigment dispersion prepared as described in Example A; and 4) 47.8 grams $Al_2(SO_4)_3$ (1.0 wt %) as a flocculent. The mixture is subsequently transferred to a 2 liter Buchi, and heated to 45.9° C. for aggregation at 750 RPM until the core particles reached a volume average particle size of 6.83 μm with 1.21 GSD. 197.0 g of the latex emulsion prepared as described above is added as a shell, to form core/shell structured particles with average particle size 8.33 μm and GSD of 1.21. The pH of the reaction slurry is increased to 6.7 by adding NaOH. 0.45 pph EDTA (based on dry toner) is added to cease particle growth, then the reaction mixture is heated for coalescence, to produce particles having a diameter of 8.07 μm and GSD 1.22. The toner slurry is then cooled to room temperature, separated by sieving (25 μm), filtered, washed, and freeze dried.

Toner Particle Example IV

Polyester Toner with 15% Magnetic FePt Pigment

The process described in Toner Particle Example III is carried out, except that 318.67 g, and not 368.24 g, of linear amorphous polyester resin emulsion; and 128.66 g of magnetic FePt/carbon black pigment dispersion from Example B, and not the magnetic Fe/carbon black pigment dispersion prepared as described in Example A, are added. The particle size is monitored until the core particles reach a volume average particle size of 6.93 μm and GSD 1.21. The core/shell structured particle has a size of 8.34 μm, GSD 1.22. The final particle size is 8.21 μm, GSD 1.22.

Toner Particle Example V

Polyester Toner with 8% Magnetic Fe Pigment

The following are added in a glass kettle and homogenized using IKA Ultra Turrax T50 homogenizer at 4000 RPM:

1) 101.43 g of amorphous polyester resin emulsion (207 nm; 33.44 wt %; 56° C. Tg); 2) 99.03 g of amorphous polyester resin emulsion (215 nm; 34.25 wt %; 60.5° C. Tg); 3) 35.56 g of crystalline polyester resin emulsion (151 nm; 25.74 wt %; 71.04° C. Tm); 4) 3.3 g of anionic surfactant Dowfax 2A1; 5) 125.08 g of magnetic Fe/carbon black pigment dispersion prepared as described in Example A; 6) 42.23 g of polyethylene wax emulsion; and 7) 350.69 g of deionized water. Thereafter a flocculent agent of 2.51 g of $Al_2(SO_4)_3$ mixed with 67.18 g of deionized water is added drop-wise to the kettle and homogenized for 10 minutes. The mixture is degassed for 20 minutes at 280 RPM, heated at a rate of 1° C. per minute to 37° C. at 350 RPM for aggregation, until the particle size is 5.0 μm. The shell mixture (58.61 g of 56° C. Tg amorphous polyester resin emulsion (207 nm; 33.44 wt %), 57.23 grams of 60.5° C. Tg amorphous polyester resin emulsion (215 nm; 34.25 wt %), 1.67 g of Dowfax 2A1 and 40.96 g of deionized water) is immediately added into the reaction and allowed to aggregate for another 10-20 minutes at 40° C., 350 RPM. As long as the volume average particle diameter is above 5.7 μm, the pH of the aggregation slurry is adjusted to 4 by adding 4 wt % of NaOH solution, followed by adding 5.38 g EDTA. The RPM is adjusted to 170 to stop aggregation, and the pH of the toner slurry is maintained at pH 7.5 by continuously adding 4 wt % of NaOH solution until the temperature reaches 85° C. for coalescence. The toner has a final particle size of 5.77 μm, GSD v/n 1.20/1.25, and circularity of 0.961. The toner slurry is then cooled to room temperature, separated by sieving (20 μm), filtered, washed, and freeze dried.

Toner Particle Example VI

Polyester Toner with 15% Magnetic FePt Pigment

The process described in Toner Particle Example V is carried out, with the following substitutions: addition of 88.52 g of amorphous polyester resin emulsion (207 nm; 33.44 wt %; 56° C. Tg); addition of 88.43 g of amorphous polyester resin emulsion (215 nm; 34.25 wt %; 60.5° C. Tg); addition of 31.07 g of crystalline polyester resin emulsion (151 nm; 25.74 wt %; 71.04° C. Tm); addition of 2.86 g of anionic surfactant Dowfax 2A1; addition of 150.1 g of magnetic FePt/carbon black pigment dispersion from Example B; and 362.1 g of deionized water.

Electrophotographic Developers

An additive package is dry blended on each of the toners, comprising 2% 40 nm silica, 1.8% 40 nm titanium oxide, 1.7% sol-gel silica, 0.5% zinc stearate. Each of the toners blended in this manner can then be combined with 65 micron steel core carrier powder coated with 1% by weight of a conductive polymer mixture comprised of poly(methylmethacrylate) and carbon black using process described in U.S. Pat. No. 5,236,629, herein incorporated by reference in its entirety. A Xerox hybrid jumping development printer DC265 can then be used to print MICR characters using an E13-B MICR font, which can be read by an RDM EasyCheck MICR Quality Control tester to verify an acceptable signal level, which to meet ANSI specifications, the magnetic signal strength of each character must be within 50-200% of the nominal signal strength to recognize the character.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner comprising:

a core comprising a crystalline and/or an amorphous polyester resin;

a shell comprising an amorphous polyester resin;

optionally one or more colorants;

optionally one or more waxes; and stabilized magnetic single-crystal nanoparticles, wherein an absolute value of the magnetic anisotropy of the magnetic single-crystal nanoparticles is greater than or equal to $2\times10^4$ J/m$^3$, and a loading of the magnetic single-crystal nanoparticles is about 0.5 weight percent to about 15 weight percent.

2. The toner according to claim 1, wherein the magnetic single-crystal nanoparticles are comprised of magnetic metallic particles.

3. The toner according to claim 1, wherein the magnetic single-crystal nanoparticles are ferromagnetic.

4. The toner according to claim 1, wherein the magnetic single crystal nanoparticles are comprised of bimetallic or trimetallic particles.

5. The toner according to claim 1, wherein the magnetic single crystal nanoparticles are comprised of at least one of Fe, Mn and Co metallic particles.

6. The toner according to claim 1, wherein the magnetic single crystal nanoparticles are selected from the group consisting of FePt, Fe, Co, FeCo, $CoO.Fe_2O_3$, CoPt, $BaO.6Fe_2O_3$, MnAl, MnBi, and mixtures thereof.

7. The toner according to claim 1, wherein the magnetic single-crystal nanoparticle is fct-phase FePt.

8. The toner according to claim 1, wherein a ratio of a major to a minor size axis of the single-crystal ($D_{major}/D_{minor}$) is less than 4:1.

9. The toner according to claim 1, wherein the magnetic single-crystal nanoparticles have a remanence of about 20 emu/gram to about 100 emu/g.

10. The toner according to claim 1, wherein the magnetic single-crystal nanoparticles have a coercivity of about 200 Oersteds to about 50,000 Oersteds.

11. The toner according to claim 1, wherein the magnetic single-crystal nanoparticles have a magnetic saturation moment of from about 20 emu/g to about 150 emu/g.

12. The toner according to claim 1, wherein a size of the magnetic single-crystal nanoparticles in all dimensions is about 10 nm to about 500 nm.

13. The toner according to claim 1, wherein a loading of the magnetic single-crystal nanoparticles have a loading of about 2 weight percent to about 10 weight percent.

14. The toner according to claim 11, wherein the colorant is present in an amount of about 0.1 to about 50 weight percent of the toner.

15. The toner according to claim 1, further comprising at least one of:

one or more charge controlling agents;

one or more surfactants; and one or more colloidal silica.

16. The toner according to claim 1, wherein the toner is an emulsion/aggregation process toner.

* * * * *